US009404636B1

(12) United States Patent
Engberg et al.

(10) Patent No.: US 9,404,636 B1
(45) Date of Patent: Aug. 2, 2016

(54) LIGHTING APPARATUS WITH A REFLECTIVE SURFACE

(71) Applicant: CHM Industries, Inc., Saginaw, TX (US)

(72) Inventors: Scott Engberg, Dallas, TX (US); Annunziata Abbatangelo, Milan (IT); Jacopo Mori, Melzo (IT)

(73) Assignee: CHM Industries, Inc., Saginaw, TX (US)

( * ) Notice: Subject to any disclaimer, the term of this patent is extended or adjusted under 35 U.S.C. 154(b) by 432 days.

(21) Appl. No.: 13/866,917

(22) Filed: Apr. 19, 2013

(51) Int. Cl.
*F21V 7/00* (2006.01)
*F21V 7/04* (2006.01)

(52) U.S. Cl.
CPC ..... *F21V 7/041* (2013.01)

(58) Field of Classification Search
CPC ..... F21V 1/06; F21V 17/06; F21V 7/18; F21V 7/0058
USPC ..... 362/297, 296, 302, 304, 311.06, 362/311.07, 311.08, 311.09, 311.1, 311.12, 362/341, 346, 347, 348, 349, 350
See application file for complete search history.

(56) References Cited

U.S. PATENT DOCUMENTS

| | | | | |
|---|---|---|---|---|
| 4,856,103 | A * | 8/1989 | Compton | F21V 3/00 362/308 |
| 5,355,290 | A * | 10/1994 | Tickner | F21S 2/00 362/294 |
| 5,377,086 | A * | 12/1994 | Tickner | F21S 8/04 362/225 |
| 5,486,989 | A * | 1/1996 | Compton | F21S 8/04 362/147 |
| 6,338,564 | B1 * | 1/2002 | Jordan et al. | 362/346 |
| 7,445,362 | B2 * | 11/2008 | Compton | F21S 8/04 362/147 |
| 2008/0061668 | A1 * | 3/2008 | Spiro | 313/113 |
| 2010/0039822 | A1 * | 2/2010 | Bailey | F21V 7/0008 362/296.1 |

* cited by examiner

*Primary Examiner* — Andrew Coughlin
(74) *Attorney, Agent, or Firm* — Gardere Wynne Sewell LLP

(57) ABSTRACT

A high mast lighting apparatus includes a shroud having a reflective surface. The shroud is configured to receive a lighting element therein. The reflective surface includes a reflective cone extending between a top portion of the shroud and the lighting element for directing light generated by the lighting element toward an open end of the shroud.

23 Claims, 2 Drawing Sheets

LIGHTING APPARATUS WITH A REFLECTIVE SURFACE

TECHNICAL FIELD

This disclosure relates to lighting apparatuses, and more particularly to lighting apparatuses for high mast applications, and even more particularly to lighting apparatuses with a reflective surface for more efficiently directing light from the lighting apparatuses to areas surrounding the lighting apparatuses.

BACKGROUND OF THE DISCLOSURE

The misdirection and/or uneven distribution of light from a lighting mechanism can decrease the overall efficiency of the lighting mechanism and require additional equipment in order to illuminate a desired area. For example, in many current high mast lighting mechanisms, excessive light is directed to an area directly below the lighting mechanism (i.e., around the base of the pole that supports the lighting mechanism) instead of being directed to outlying areas that are desired to be illuminated. Current attempts to efficiently direct light away from an area directly below the lighting mechanism include complex and expensive reflective shrouds that encase the lighting element. In the case of outdoor high mast lighting, the complex and expansive shrouds are exposed to environmental influences such as rain, failing debris, snow and hail that can damage the shroud and cause light to be misdirected from damaged portions of the shroud. It would be beneficial to have a lighting mechanism, suitable for all conditions of service that, among other things, more efficiently directs light from the lighting mechanism and in particular, is capable of effectively directing light away from an area directly below the lighting mechanism.

SUMMARY

In a first aspect, there is provided a high mast lighting apparatus that includes a shroud having a reflective surface, the shroud configured to receive a lighting element therein. The reflective surface may include a reflective cone extending between a top portion of the shroud and the lighting element for directing light generated by the lighting element toward an open end of the shroud.

In certain embodiments, the reflective surface is coupleable to the shroud.

In other embodiments, the shroud is supported on a post.

In yet another embodiment, the reflective surface includes a plurality of segments, wherein at least one of the segments is in the shape of an annulus.

In still another embodiment, the plurality of segments include fold lines for selectively bending the segments.

In some embodiments, the reflective surface is located within the shroud and is spaced from the shroud.

In another embodiment, the shroud further includes an annular protrusion and the reflective surface is connected to the shroud at the annular protrusion.

In certain embodiments, the reflective surface includes an opening at a center of the reflective surface to receive the lighting element.

In certain other embodiments, the reflective cone encircles the lighting element.

In a second aspect, there is provided a reflective surface that includes a main reflective body and a reflective cone. The main reflective body may include a first segment and a second segment, wherein the second segment is in the shape of a truncated dome. The reflective cone may be disposed within the truncated dome of the second segment. The reflective cone and the main reflective body may include rows of planar portions, wherein a top row planar portion of the reflective cone is at an angle of between about 80 and about 100 degrees to an adjacent planar portion of a top row of the main reflective body.

In certain embodiments, the reflective cone includes an opening to receive at least a portion of the lighting element.

In other embodiments, the planar portions are formed of aluminum.

In yet other embodiments, the reflective cone includes at least one opening in the top portion of the reflective cone for the passage of heated air from a lighting element.

In still another embodiment, the main reflective body includes a first segment that is couplable to a second segment.

In some embodiments, the first segment includes a plurality of forming segments connectable to form an annulus and the second segment includes a plurality of forming segments connectable to form an annulus.

In other embodiments, the forming segments comprise fold lines.

In a third aspect, there is provided a lighting apparatus that includes a shroud and a reflective surface. The shroud may include an annular protrusion on an internal surface of the shroud. The reflective surface may be disposed within the shroud, wherein the reflective surface is spaced from the shroud and is couplable to the shroud at the annular protrusion.

In certain embodiments, the shroud is concave in shape and the reflective surface includes a concave main reflective body and a convex reflective cone.

In other embodiments, the convex reflective cone is located at a central axis of the shroud and encircles a lighting element.

In yet other embodiments, the annular protrusion is located near an open end of the shroud.

In still another embodiment, the reflective surface is made by physical vapour deposition.

In other embodiments, the reflective surface is 98 percent reflective.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
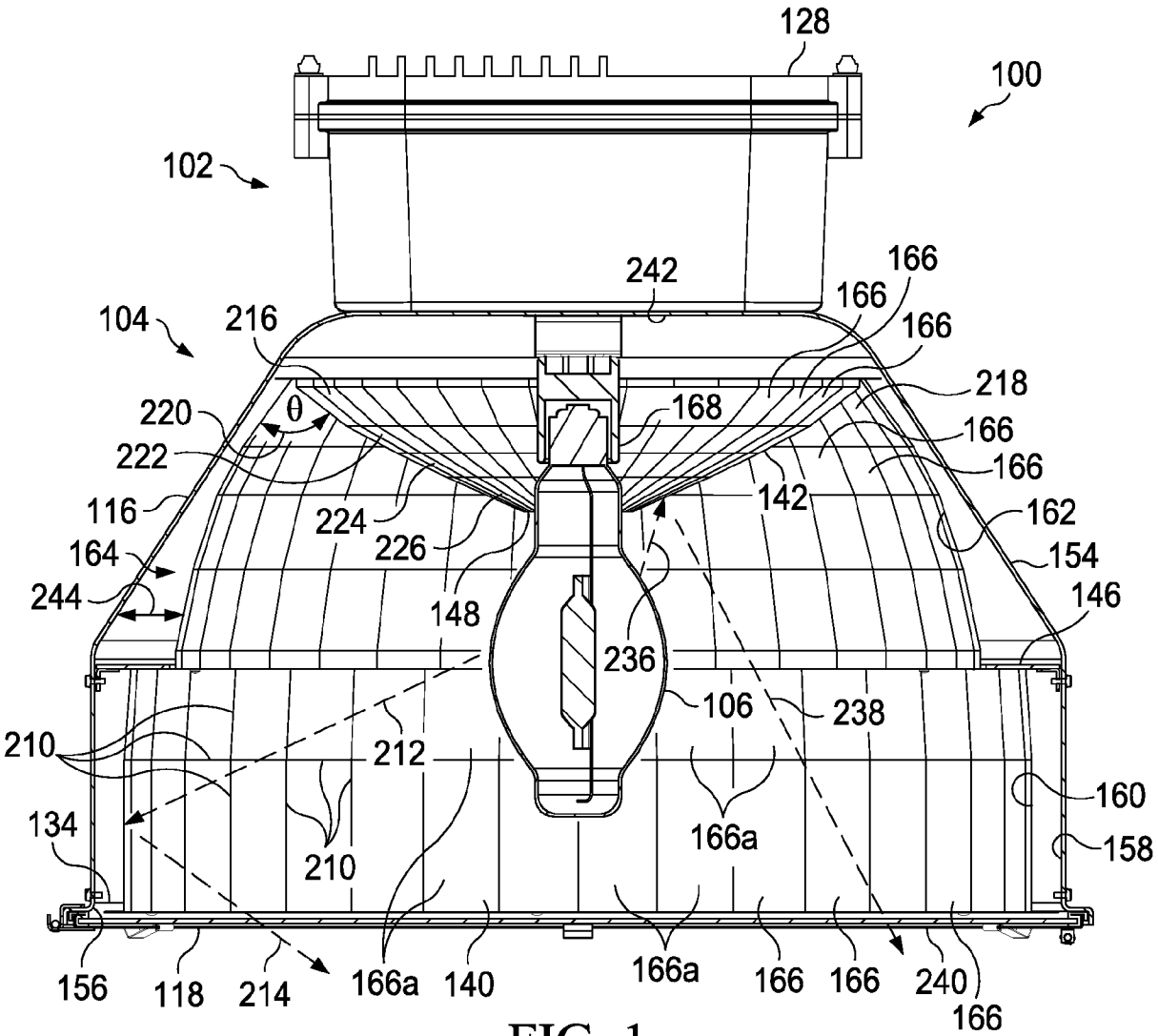
FIG. 1 is a cutaway front view of a lighting apparatus with a reflective surface.
Figure 2:
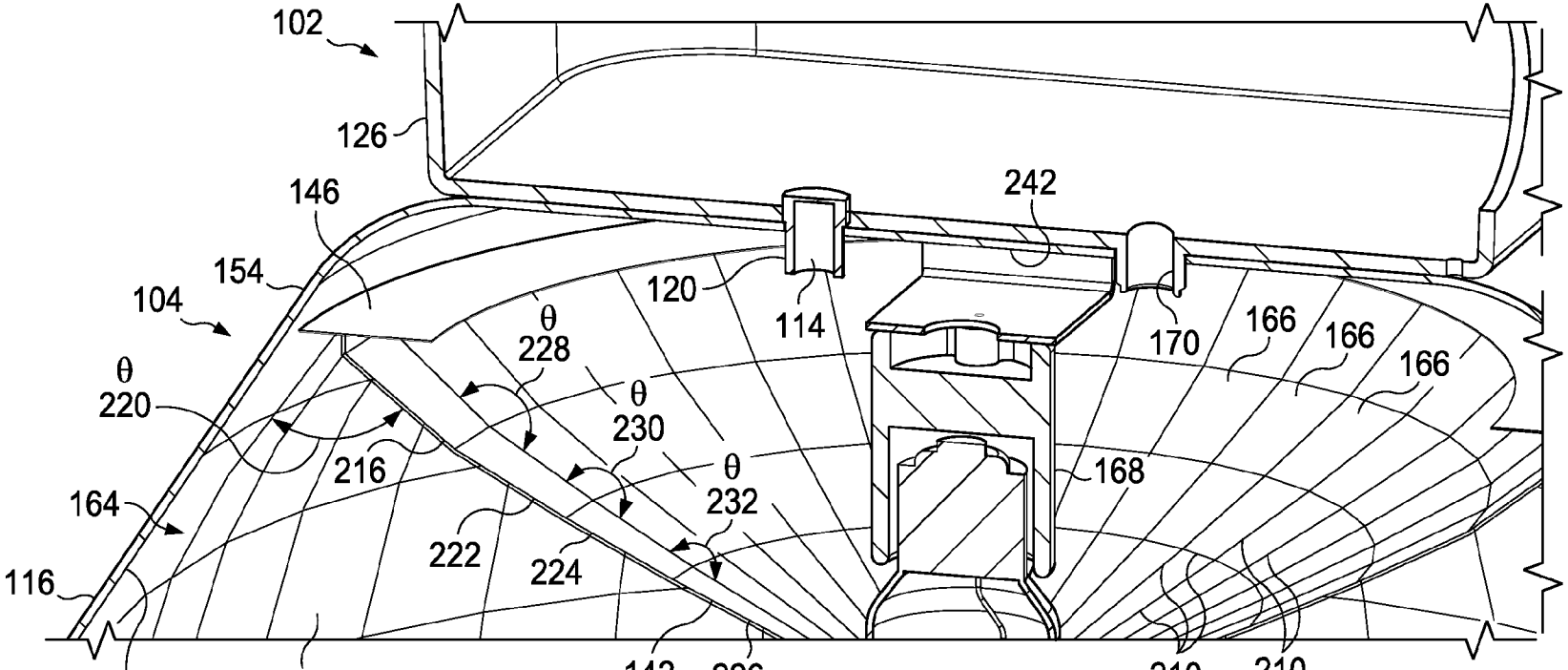
FIG. 2 is a close-up, perspective view of the lighting apparatus of FIG. 1.

Referring to FIGS. 1 and 2, a lighting apparatus 100 is shown that includes a reflective surface 140 for directing light generated by a lighting element 106 away from an area directly below the lighting apparatus 100 (i.e., around the base of the pole that supports the lighting mechanism) to outlying areas where additional light is desired and/or necessary. In addition, the lighting apparatus 100 includes a lighting element housing 104 that protects the reflective surface 140 and is spaced from the reflective surface 140 so that damage to the lighting element housing 104 (i.e., dents/bending/etc. from hail, wind and rain) does not affect the reflective surface 140. The lighting apparatus 100 is inexpensive and simple to manufacture and can be economically shipped, as will be described in more detail below.

In general, the lighting apparatus 100 includes a connector 102, such as a ballast housing 128, to connect the lighting apparatus 100 to a support structure, such as, for example, a pole, building wall, or ceiling structure. The lighting apparatus 100 further includes a lighting apparatus housing 104 that is connected with the connector 102 and includes a protective shroud 116, and a reflective surface 140 located within the protective shroud 116 for directing light from a lighting element 106 that is positioned within the protective shroud 116.

The connector 102 may be any suitable linking mechanism used to secure the apparatus 100 to a support structure. In some embodiments, the connector 102 is a ballast housing 128 that may also include elements for powering and controlling the apparatus 100, such as, for example, a power cord and ballast (not shown).

The lighting element housing 104 is connected to the connector 102 and includes the protective shroud 116, the reflective surface 140 and the lighting element 106. The protective shroud 116 may be in the form of any suitable shape and made of any suitable material, such as, for example, metal or plastic. In some embodiments, the protective shroud 116 is formed of a rigid material that protects the elements within the shroud 116, such as the reflective surface 140 and the lighting element 106. In some embodiments, the protective shroud 116 is positioned around the reflective surface 140 so that the reflective surface 140 is completely encircled by the protective shroud 116 to protect the reflective surface 140 from external elements, such as, for example, hail, rain, falling debris and dirt.

In the embodiments illustrated in FIGS. 1 and 2, the protective shroud 116 is generally dome-shaped and is slightly larger than the reflective surface 140 disposed therein. However, the protective shroud 116 may be any suitable shape that is slightly larger than the reflective surface 140. In some embodiments, for example, the protective shroud 116 is cone-shaped. In some embodiments, the protective shroud 116 is rectangular in shape. In some embodiments, the protective shroud 116 is dome-shaped and is made of 0.1 inch thick spun aluminum.

According to some embodiments, the protective shroud 116 includes a transparent cover 118 disposed on a bottom surface 156 of the protective shroud 116 to further protect the reflective surface 140 from the outside environment. The cover 118 may form an airtight seal to the protective shroud 116 such that the volume within the protective shroud 116 is completely closed off and sealed from the ambient air. Thus, the volume between the protective shroud 116 and the cover 118 may be closed off from airborne contaminants in the ambient air which could contaminate a surface of the lighting element 106, an internal surface 234 of the cover 118 and/or the reflective surface 140, thereby increasing the luminaire dirt deprecation and decreasing the overall efficiency of the lighting apparatus 100. The cover 118 may also prevent intrusion from living organisms, such as insects and small animals, which may damage or otherwise decrease the efficiency of the lighting apparatus 100. The cover 118 is formed of any suitable material, such as, for example, glass or plastic, and is attachable to the protective shroud 116 by any suitable attachment mechanism(s).

According to some embodiments, the apparatus 100 can be constructed without a cover 118 thus exposing the lighting element 106 to the environment. In other embodiments, rather than forming an air-tight connection, the cover 118 is for example, a mesh-type material that prevents entry of contaminants over a certain size into the volume between the protective shroud 116 and the cover 118. In some embodiments, the cover 118 need not be made of sag glass and need not include light baffles due to the light spreading caused by the reflective surface 140, as will be discussed in more detail below.

In the embodiment illustrated in FIG. 1, the protective shroud 116 includes an annular protrusion 134 located near a bottom surface 156 of the protective shroud 116 and an annular protrusion 146 located above the annular protrusion 134. In some embodiments, the reflective surface 140 is connectable to the protective shroud 116 at one or more of the annular protrusions 134 and 146. The reflective surface 140 may be attached to the protective shroud 116 at one or more of the annular protrusions 134 and 146 by any suitable attachment mechanisms, for example, by screws, bolts or the like. Thus, in the embodiment illustrated in FIGS. 1 and 2, the reflective surface 140 may be easily attached and/or removed from the protective shroud 116.

When the reflective surface 140 is connected to the protective shroud 116, the reflective surface 140 is spaced apart from an inner surface 158 of the protective shroud 116 so that damage to the protective shroud 116 does not affect and/or otherwise impact the reflective surface 140. The distance between the reflective surface 140 and the protective shroud 116, for example, the distance shown by the arrow labeled 244 in FIG. 1, provides a buffer area between the protective shroud 116 and the reflective surface 140. Thus, for example, if a projectile contacts and dents the protective shroud 116, the dent may extend into the buffer area between the protective shroud 116 and the reflective surface 140 without damaging the reflective surface 140.

The reflective surface 140 is configured to efficiently direct light from the lighting element 106 through an open end 240 of the protective shroud 116. Specifically, the reflective surface 140 is configured to direct light away from an area directly below the lighting apparatus 100, typically where a support pole is located. In general, the reflective surface 140 includes a main reflective body 164 and a reflective cone portion 142. The main reflective body 164 includes a first segment 160 and a second segment 162, each of which is generally in the shape of a convex truncated dome that may be similar to the convex shape of the protective shroud 154. The first segment 160 is located adjacent to the bottom surface 156 of the protective shroud 116 and is coupled to the second segment 162. The second segment 162 is coupled to the first segment 160 on a lateral end of the second segment 162 and to the reflective cone 142 on an opposite lateral end of the second segment 162. In some embodiments, the reflective cone 142 is located within a truncated portion of the second segment 162, as shown in FIG. 1. The first segment 160, second segment 162 and reflective cone 142 may be one integral piece or, in the alternative, may be separate pieces that are coupled together by known fastening mechanisms.

The first segment 160, the second segment 162 and the reflective cone 142 are each formed of rows of interconnected, planar portions 166 made of a reflective material, such as, for example, high reflectivity aluminum that is 98 percent reflective. In some embodiments, the planar portions 166 are made by physical vapour deposition in which the base material is aluminum which is coated by 99.99 percent pure silver. In some embodiments, the planar portions 166 include a protective layer, a reflective layer, a silver layer which is applied using physical vapour deposition, a bonding layer and an anodized aluminum substrate.

The first segment 160, second segment 162 and reflective cone 142 include fold lines 210 at the intersection of the planar portions 166 which allow for selectively bending the first segment 160, the second segment 162 and the reflective cone 142 at the fold lines 210. The fold lines 210 may be, for example, scored portions of the first segment 160, the second segment 162 and the reflective cone 142 that allow for bending of the first segment 160, the second segment 162 and the reflective cone 142 in an area between the planar portions 166 so that the first and second segments 160 and 162 may be formed into the shape of an annulus and the reflective cone 142 may be formed into the shape of a cone 142, as shown in FIG. 1.

In some embodiments, the first segment 160, the second segment 162 and the reflective cone 142 are each formed of one or more forming segments, which are sheets of one or more interconnected, adjacent planar portions 166. For example, in some embodiments, the planar portions 166 of the first segment 160 that are labeled **166*a* in FIG. 1 together form a forming segment that may be linked to other forming segments to create the first segment 160. When assembled, the forming segments are connected so that an end of one forming segment is connected to an end of an adjacent forming segment. The fold lines 210 of the forming segments provide an axis upon which the forming segments bend to form the generally annular shape of the first segment 160, the second segment 162 or the cone shape of the reflective cone 142**. The forming segments are attached together by any suitable attachment mechanism. For example, in some embodiments, pliable metal tabs are included on one end of the forming segments and corresponding openings are included on an opposite end of the forming segments so that the metal tabs of a forming segment can be attached to the openings of an adjacent forming segment.

The forming segments are substantially planar until they are selectively bent along the fold lines 210 and attached to adjacent forming segments to form the shapes of the first segment 160, the second segment 162 and/or the reflective cone 142. Thus, the parts that form the reflective surface 140, specifically the first segment 160, the second segment 162 and the reflective cone 142, may each be manufactured as substantially flat pieces, shipped as flat pieces and then easily assembled into the appropriate shapes upon delivery.

The reflective cone 142 is generally in the shape of a truncated cone and is convex compared with the concave shape of the main reflective body 164 and the protective shroud 116. The reflective cone 142 encircles the lighting element 106 and/or a socket 168 connected to the lighting element 106 and includes an opening 148 to receive the lighting element 106 and/or the socket 168. As such, the reflective cone 142 extends between a top portion 242 of the protective shroud 116 and the lighting element 106 for directing light generated by the lighting element 106 toward the open end 240 of the protective shroud 116. As shown in FIG. 1, the reflective cone 142 is located at a central axis of the protective shroud 116.

In some embodiments, the reflective cone 142 protrudes from an inner surface 158 of the protective shroud 116 such that an angle, labeled 220 in FIGS. 1 and 2, between a planar portion 166 of a first row 216 of planar portions 166 of the reflective cone 142 and an adjacent planar portion 166 of a first row 218 of planar portions 166 of the second segment 162 is between about 80 and 100 degrees. In some embodiments, the angle 220 is about 87 degrees. In some embodiments, the angle 220 is about 87.8 degrees.

Referring now specifically to FIG. 2, the reflective cone 142 includes a first row 216, a second row 222, a third row 224 and a fourth row 226 of planar portions 166. The angle between the first row 216, second row 222, third row 224 and fourth row 226 of planar portions 166 determines the direction of light that is reflected from the planar portions 166 of the reflective cone 142. In some embodiments the first row 216 of planar portions 166 of the reflective cone 142 is at an angle 228 to the second row 222 of planar portions 166 of the reflective cone 142 that is about 170 degrees. In some embodiments, the second row 222 of planar portions 166 is at an angle 230 to the third row 224 of planar portions 166 that is about 178 degrees. In some embodiments, the third row 224 of planar portions 166 is at an angle 232 to the fourth row 226 of planar portions 166 that is about 178 degrees.

In operation, the reflective surface of the planar portions 166 of the first segment 160, the second segment 162 and the reflective cone 142 spreads and/or otherwise disperses light generated by the lighting element 106. Referring specifically to FIG. 1, light that is emitted from the lighting element 106 in a direction such as that of the arrow labeled 212 in FIG. 1, may be directed in a direction such as that of the arrow labeled 214. Light that is emitted from the lighting element 106 away from the open end 240 of the protective shroud 116, such as in the direction of the arrow labeled 236 in FIG. 1, may also be directed in a direction away from an area directly below the lighting apparatus 100, such as that of the arrow labeled 238. Thus, light is directed away from an area directly below the lighting apparatus 100, typically where the pole supports the lighting apparatus above the ground, to outlying areas to more efficiently light a given area.

In use, the apparatus 100 may be coupled to a post, building wall, ceiling element or some other support and may be directed toward an area that is to be illuminated. The open end 240 of the lighting apparatus 100 is directed toward a ground, or downwardly, or may be directed in another direction, for example, toward a ceiling, or upwardly. Terms such as top, bottom, above, below, upward and downward, and similar terms, are used with reference to FIGS. 1 and 2 to conveniently describe the apparatus 100, and it will be understood that those terms are to be adjusted depending on the orientation of the lighting apparatus 100. Thus, for example, if the lighting apparatus 100 is directly upwardly (i.e., opposite of the orientation shown in FIG. 1), the top portion 242 of the protective shroud 116 would be located towards a lower end of the apparatus 100.

The lighting element 106 produces light which either escapes directly through the open end 240 of the protective shroud 154 or is reflected by the reflective surface 140 to exit through the open end 240. Light that contacts the reflective cone 142 is generally directed away from a location directly below the lighting apparatus 100 due to the protruding, convex shape of the reflective cone 142 and the concave shape of the first segment 160 and the second segment 162. As such, light from the lighting apparatus 100 is more efficiently spread and the overall efficiency of the lighting apparatus 100 may be improved.

In some additional embodiments, heated air from the lighting element 106 travels through the opening 148 in the reflective cone 142 or otherwise become positioned inside the reflective cone 142. Furthermore, in order to permit the escape of heated air from the reflective cone 142, the first row of 216 of planar portions 166 of the reflective cone 142 may include one or more openings (not shown) to allow heated air to pass through the openings and out of the reflective cone 142.

As described above, in the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. As stated above, terms such as "top", "bottom", "above", "below", "upward" and "downward" and the like are used as words of convenience to provide reference points and are not to be construed as limiting terms.

In this specification, any use of the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention(s) are not to be limited to the disclosed embodiments, but on the contrary, are intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A high mast lighting apparatus, comprising:

a shroud configured to support a reflective surface;

the reflective surface including a reflective cone extending from a top portion of the shroud and defining a central opening to receive a lighting element, the reflective cone for directing light generated by the lighting element toward an open end of the shroud, the reflective cone comprising a first annulus formed of circumferentially adjacent first planar segments and having a first diameter and a second annulus coupled to the first annulus, the second annulus formed of circumferentially adjacent second planar segments and having a second diameter, the second diameter being less than the first diameter, at least one of the first annulus and the second annulus surrounding the central opening.

2. The high mast lighting apparatus of claim 1, wherein the shroud is supported on a post.

3. The high mast lighting apparatus of claim 1, wherein the first annulus and the second annulus each comprises a plurality of fold lines disposed between the first planar segments and between the second planar segments, the plurality of fold lines enabling bending between circumferentially adjacent planar segments.

4. The high mast lighting apparatus of claim 1, wherein the reflective surface is coupled to and is spaced from the shroud.

5. The high mast lighting apparatus of claim 1, wherein the shroud further comprises an annular protrusion and the reflective surface is connected to the shroud at the annular protrusion.

6. The high mast lighting apparatus of claim 1, wherein the reflective cone encircles the lighting element disposed within the central opening.

7. The high mast lighting apparatus of claim 1 wherein an angle between the first annulus and the second annulus is greater than or equal to 170 degrees and less than or equal to 178 degrees.

8. A reflective surface, comprising:

a main reflective body including a first segment and a second segment, wherein the second segment is in the shape of a truncated dome; and a reflective cone disposed within the truncated dome of the second segment, wherein the reflective cone and the main reflective body comprise rows of planar portions, wherein a top row planar portion of the reflective cone is at an angle of between about 80 and about 100 degrees to an adjacent planar portion of a top row of the main reflective body; and wherein the reflective cone comprises a first row of circumferentially adjacent planar portions forming a first annulus having a first diameter and a second row of circumferentially adjacent planar portions forming a second annulus and having a second diameter; the first diameter being greater than the second diameter, at least one of the first annulus and the second annulus surrounding a central opening in the reflective cone, the central opening being configured to receive a lighting element.

9. The reflective surface of claim 8, wherein the lighting element is disposed within the central opening.

10. The reflective surface of claim 8, wherein the planar portions are formed of aluminum.

11. The reflective surface of claim 8, wherein the central opening is configured to permit passage of heated air from the lighting element.

12. The reflective surface of claim 8, wherein the first segment is coupled to the second segment.

13. The reflective surface of claim 12, wherein the first segment comprises a plurality of forming segments and the second segment comprises a plurality of forming segments.

14. The reflective surface of claim 8, wherein the first annulus and the second annulus each comprises a plurality of fold lines disposed between the first planar portions and between the second planar portions, the plurality of fold lines enabling bending between circumferentially adjacent planar segments.

15. The reflective surface of claim 8 wherein an angle between the first annulus and the second annulus is greater than or equal to 170 degrees and less than or equal to 178 degrees.

16. A lighting apparatus, comprising:

a shroud comprising an annular protrusion on an internal surface of the shroud; and a reflective surface disposed within the shroud, wherein the reflective surface is spaced from the shroud and is couplable to the shroud at the annular protrusion, the reflective surface comprising a reflective cone having first circumferentially adjacent planar portions forming a first annulus having a first diameter and second circumferentially adjacent planar portions forming a second annulus and having a second diameter; the first diameter being greater than the second diameter and the first annulus being disposed closer to a base of the reflective cone than the second annulus, at least one of the first annulus and the second annulus surrounding a central opening in the reflective cone, the central opening being configured to receive a lighting element.

17. The lighting apparatus of claim 16, wherein an inner surface of the shroud is concave in shape and the reflective surface comprises a concave main reflective body.

18. The lighting apparatus of claim 17, wherein the lighting element is disposed within the central opening.

19. The lighting apparatus of claim 16, wherein the annular protrusion is located near an open end of the shroud.

20. The lighting apparatus of claim 16, wherein the reflective surface is made by physical vapour deposition.

21. The lighting apparatus of claim 16, wherein the reflective surface is 98 percent reflective.

22. The high mast lighting apparatus of claim 16 wherein each of the first planar portions is separated from an adjacent first planar portion by a fold line, and each of the second planar portions is separated from an adjacent second planar portion by a fold line, the fold lines enabling bending between circumferentially adjacent planar portions.

23. The lighting apparatus of claim 16 wherein an angle between the first annulus and the second annulus is greater than or equal to 170 degrees and less than or equal to 178 degrees.

* * * * *